US009085175B2

(12) United States Patent
Okuno et al.

(10) Patent No.: US 9,085,175 B2
(45) Date of Patent: Jul. 21, 2015

(54) RECORDING APPARATUS

(75) Inventors: Tokujiro Okuno, Matsumoto (JP); Hiroshi Ue, Matsumoto (JP); Atsushi Sumii, Shiojiri (JP); Mitsuhiro Koseki, Chino (JP)

(73) Assignee: Seiko Epson Corporation, Tokyo (JP)

( * ) Notice: Subject to any disclaimer, the term of this patent is extended or adjusted under 35 U.S.C. 154(b) by 342 days.

(21) Appl. No.: 13/406,716

(22) Filed: Feb. 28, 2012

(65) Prior Publication Data

US 2012/0218361 A1 Aug. 30, 2012

(30) Foreign Application Priority Data

Feb. 28, 2011 (JP) ..... 2011-042262

(51) Int. Cl.

| | |
|---|---|
| ***B41J 2/01*** | (2006.01) |
| ***B41J 11/00*** | (2006.01) |
| ***B41J 11/06*** | (2006.01) |
| *B41J 11/02* | (2006.01) |

(52) U.S. Cl.

CPC ..... *B41J 11/0065* (2013.01); *B41J 11/06* (2013.01); *B41J 11/02* (2013.01)

(58) Field of Classification Search

CPC ..... B41J 11/00; B41J 11/001; B41J 11/0025; B41J 11/0045; B41J 11/02; B41J 11/005; B41J 11/057; B41J 13/10; B41J 13/103; B41J 13/106; B41J 11/0065; B41J 11/06; B41J 11/0085; B41J 3/28; B41J 11/08; B41J 25/308; B41J 11/20

USPC ..... 347/104, 101, 16

See application file for complete search history.

(56) References Cited

U.S. PATENT DOCUMENTS

| | | | | |
|---|---|---|---|---|
| 5,975,665 | A * | 11/1999 | Torigoe et al. | 347/7 |
| 6,149,045 | A * | 11/2000 | Kadono | 226/196.1 |
| 6,305,098 | B1 * | 10/2001 | Guglielmero | 34/104 |
| 6,325,504 | B1 * | 12/2001 | Tomii et al. | 347/104 |
| 6,347,853 | B1 * | 2/2002 | Kato | 347/7 |

(Continued)

FOREIGN PATENT DOCUMENTS

| | | | |
|---|---|---|---|
| JP | 02099374 A | * | 4/1990 |
| JP | 03007371 A | * | 1/1991 |

(Continued)

OTHER PUBLICATIONS

Extended European Search Report dated Jul. 19, 2012 for European Patent Application No. 12156877.8.

*Primary Examiner* — Julian Huffman
*Assistant Examiner* — Leonard S Liang
(74) *Attorney, Agent, or Firm* — Workman Nydegger

(57) ABSTRACT

A recording apparatus includes: a plurality of first ribs provided at predetermined intervals in a direction intersecting with a direction along which a recording target medium is transported; a plurality of second ribs provided at predetermined intervals in the direction intersecting with the direction along which the recording target medium is transported, the plurality of second ribs being provided downstream of the plurality of first ribs for guiding the recording target medium to a downstream side, the plurality of second ribs being provided at an area where the plurality of second ribs can face the recording head; a first member that is made of a resin material that is used as a material of the plurality of first ribs; and a second member that is made of a metal material that is used as a material of the plurality of second ribs.

14 Claims, 9 Drawing Sheets

(56) References Cited

U.S. PATENT DOCUMENTS

| | | | | |
|---|---|---|---|---|
| 6,796,648 | B2 * | 9/2004 | Ohashi | 347/104 |
| 7,367,642 | B2 * | 5/2008 | Ouchi et al. | 347/14 |
| 7,377,633 | B2 * | 5/2008 | Kodama et al. | 347/104 |
| 7,469,984 | B2 * | 12/2008 | Niioka | 347/14 |
| 7,690,640 | B2 * | 4/2010 | Koga et al. | 271/9.13 |
| 8,752,827 | B2 * | 6/2014 | Lee | 271/224 |
| 2002/0089564 | A1 * | 7/2002 | Ohashi | 347/41 |
| 2004/0085427 | A1 * | 5/2004 | Lee | 347/104 |
| 2004/0126164 | A1 * | 7/2004 | Ohyama | 400/58 |
| 2004/0183850 | A1 | 9/2004 | Takeuchi | |
| 2004/0189777 | A1 * | 9/2004 | Sugiura et al. | 347/104 |
| 2005/0195258 | A1 * | 9/2005 | Nukui | 347/101 |
| 2005/0195262 | A1 * | 9/2005 | Takeda et al. | 347/103 |
| 2006/0023052 | A1 * | 2/2006 | Watanabe et al. | 347/104 |
| 2006/0103711 | A1 * | 5/2006 | Kodama et al. | 347/104 |
| 2006/0221111 | A1 * | 10/2006 | Ouchi et al. | 347/16 |
| 2006/0268087 | A1 * | 11/2006 | Sasa | 347/101 |
| 2007/0064078 | A1 * | 3/2007 | Nishi et al. | 347/104 |
| 2007/0070113 | A1 * | 3/2007 | Kawabata et al. | 347/20 |
| 2007/0138418 | A1 | 6/2007 | Sasa | |
| 2007/0165059 | A1 * | 7/2007 | Nishizaka | 347/19 |
| 2007/0176996 | A1 | 8/2007 | Yoshida | |
| 2008/0024531 | A1 * | 1/2008 | Bastani et al. | 347/8 |
| 2009/0122098 | A1 * | 5/2009 | Shindo | 347/17 |
| 2010/0026772 | A1 | 2/2010 | Miyata | |

FOREIGN PATENT DOCUMENTS

| | | | | |
|---|---|---|---|---|
| JP | 08110665 | A | * | 4/1996 |
| JP | 2003043824 | A | * | 2/2003 |
| JP | 2005-212205 | | | 8/2005 |
| JP | 2005-262832 | | | 9/2005 |
| JP | 2005298143 | A | * | 10/2005 |
| JP | 2006247884 | A | * | 9/2006 |
| JP | 2008179106 | A | * | 8/2008 |

* cited by examiner

RECORDING APPARATUS

BACKGROUND

1. Technical Field

The present invention relates to a recording apparatus that is provided with ribs for guiding a recording target medium to the downstream side.

2. Related Art

A recording apparatus such as a facsimile or a printer, especially, an ink-jet printer, includes a guiding member (also called as platen) provided at a position where it faces a recording head. The guiding member is provided with a plurality of ribs for guiding the recording target medium to the downstream side. The ribs are formed at predetermined regular intervals in the direction orthogonal to the direction along which a recording target medium such as recording paper is transported. The ribs have a function of forming regular ups and downs (cockling) in paper that gets swollen as it absorbs ink, thereby avoiding serious irregularity in the distance between the paper and a recording head (hereinafter referred to as "paper gap") (for example, refer to JP-A-2005-212205 and JP-A-2005-262832).

In some recording apparatuses, ribs for guiding (supporting) paper are separately arranged as upstream ribs and downstream ribs. The reason why they are separately arranged is as follows. For example, let us consider that a recording apparatus has the following structure; an optical sensor is provided on a carriage, on which a recording head is mounted, so as to detect the width of paper by optical sensing as disclosed in JP-A-2005-212205 and JP-A-2005-262832; if the ribs are formed at positions where they face the optical sensor, the problem of false detection will arise. To avoid false detection, the ribs are split at the position facing the optical sensor in the recording apparatus disclosed in JP-A-2005-212205 and JP-A-2005-262832.

When an ink-jet printer that can perform so-called borderless printing, which is a technique that utilizes the entire sheet of paper for a printout while leaving no white spaces around the edges, is used, it is necessary to eject ink onto not only an area inside the leading edge and the rear edge of paper but also areas outside these edges for such printing. For this reason, ribs are separately arranged for leaving a space of a cavity into which ink is to be discarded. That is, the ribs are separately arranged as upstream ribs and downstream ribs so as to form the ink-discarding cavity.

In some cases, in order to prevent the rising of paper from ribs, the paper is transported while being pressed against the ribs by means of a transportation roller. When a resin material is used as the material of the guiding member that is provided with the ribs described above for cost reduction or any other reason, there is a risk that the ribs might wear due to the pressing of paper against the ribs, which causes problems resulting from the wear (e.g., a change in a paper gap or the position/attitude, etc. of paper).

On the other hand, in sensing by means of an optical sensor, an optical reflectance difference between paper and an area outside the paper has to be large; the use of a metal material for the purpose of preventing the wear of ribs should be avoided. The reflection factor of a metal material is high. A metal material requires after-treatment such as coating. In addition, it is difficult to obtain a proper optical reflectance difference after the coating has come off. For these reasons, the use of a metal material should be avoided.

SUMMARY

An advantage of some aspects of the invention is to provide a recording target medium transportation apparatus that can keep high recording quality for a long period of time by preventing the wear of ribs and can perform sensing operation properly by means of an optical sensor.

A recording apparatus according to a first aspect of the invention includes: a transportation path along which a recording target medium is transported; a recording head for recording on the recording target medium; a plurality of first ribs provided on the transportation path at predetermined intervals in a direction intersecting with a direction along which the recording target medium is transported; a plurality of second ribs provided at predetermined intervals in the direction intersecting with the direction along which the recording target medium is transported, the plurality of second ribs being provided downstream of the plurality of first ribs for guiding the recording target medium to a downstream side, the plurality of second ribs being provided at an area where the plurality of second ribs can face the recording head; a first member that is made of a resin material that is used as a material of the plurality of first ribs; and a second member that is made of a metal material that is used as a material of the plurality of second ribs.

Since the second ribs for prescribing a distance between the recording head and the recording target medium is made of a metal material, the first aspect of the invention makes it possible to prevent the wear of the second ribs, thereby keeping high recording quality for a long period of time.

As a second mode, it is preferred that a recording apparatus according to the first aspect of the invention should further include a plurality of third ribs provided at predetermined intervals in the direction intersecting with the direction along which the recording target medium is transported, the plurality of third ribs being provided downstream of the plurality of second ribs for guiding the recording target medium to the downstream side, the plurality of third ribs being made of the resin material.

In the preferred mode described above, the third ribs, which are provided downstream of the second ribs, and the first ribs are formed integrally on the first member. Therefore, it is possible to form the first ribs at low cost.

As a third mode, in a recording apparatus according to the second mode of the invention, it is preferred that a height of the first rib should be greater than a height of the second rib; in addition, the height of the second rib should be greater than a height of the third rib.

When ink is ejected onto a recording target medium, the recording-side surface of the recording target medium gets swollen. Therefore, the recording target medium tends to form into an upwardly convex shape. When the leading edge of a recording target medium that is in such a state moves over the first, second, and third ribs, the leading edge would raise itself if the surface of an upstream-side rib and the surface of a downstream-side rib were at the same level. This would make a gap between the recording head and the recording target medium improper. In the preferred mode described above, the height of the first rib is greater than the height of the second rib; in addition, the height of the second rib is greater than the height of the third rib. In other words, in the rib arrangement according to the preferred mode described above, the surface level of a downstream-side rib is lower than that of an upstream-side rib. Therefore, when the leading edge of a recording target medium moves over the first rib, the second rib, and the third rib in this order, the rising of the leading edge of the recording target medium does not occur.

As a fourth mode, in a recording apparatus according to the second or third mode of the invention, it is preferred that the first ribs should be formed on a first-rib forming surface of the first member; the second ribs should be formed on a second-rib forming surface of the second member; the third ribs should be formed on a third-rib forming surface of the first member; and a level of the second-rib forming surface should be higher than a level of the first-rib forming surface and, in addition, be higher than a level of the third-rib forming surface.

In the preferred mode described above, the level of the first-rib forming surface is lower than that of the second-rib forming surface; in addition, the level of the third-rib forming surface is lower than that of the second-rib forming surface. Since the recording apparatus has such a structure, the first-rib forming surface and the third-rib forming surface, both of which are formed by using a resin material (of which the first member is made) and are easily charged with electricity, are located at a relatively long distance from the recording head as compared with a distance between the recording head and the second-rib forming surface, which is formed by using a metal material and is not easily charged with electricity. This prevents the generation of an intense electric field between the recording head and the surface and thus prevents adverse effects on the landing precision of ink ejected from the recording head.

As a fifth mode, in a recording apparatus according to any of the first aspect, the second, third and fourth modes of the invention, it is preferred that a width of the second rib should be larger than a width of the first rib.

When a recording target medium is fed back for the purpose of duplex recording on both surfaces thereof, there is a risk that the rear edge of the recording target medium might get snagged on the first ribs when it is transported from the second ribs to the first ribs. In the preferred mode described above, since the width of the second rib is larger than that of the first rib, relatively large curves (cockling) will be formed in a recording target medium at the second ribs. This prevents the rear edge of the recording target medium from getting snagged on the first ribs when it is transported from the second ribs to the first ribs.

As a sixth mode, in a recording apparatus according to any of the second, third, and fourth modes of the invention, it is preferred that a width of the second rib should be larger than a width of the first rib and, in addition, be larger than a width of the third rib.

When a recording target medium is transported, there is a risk that the leading edge of the recording target medium might get snagged on the third ribs when it is transported from the second ribs to the third ribs. In the preferred mode described above, since the width of the second rib is larger than that of the third rib, relatively large curves will be formed in a recording target medium at the second ribs. This prevents the leading edge of the recording target medium from getting snagged on the third ribs when it is transported from the second ribs to the third ribs.

As a seventh mode, it is preferred that a recording apparatus according to any of the first aspect, the second, third, fourth, fifth, and sixth modes of the invention should further include a frame member that supports the first member at two ends thereof in the direction intersecting with the direction along which the recording target medium is transported and supports the second member at two ends thereof in the direction intersecting with the direction along which the recording target medium is transported, wherein the second member is supported somewhere between the two ends by the first member.

In the preferred mode described above, the second member is supported somewhere between the two ends by the first member, thereby preventing the deflection of the second member in the direction intersecting with the direction along which the recording target medium is transported or making it less deflective. This makes it possible to keep a proper gap between the recording head and the recording target medium.

As an eighth mode, in a recording apparatus according to any of the first aspect, the second, third, fourth, fifth, sixth, and seventh modes of the invention, it is preferred that the recording head and the second member should be set at the same electric potential.

In the preferred mode described above, the recording head and the second member are set at the same electric potential, which prevents the generation of an electric field between the recording head and the second member, thereby ensuring that the landing precision of ink ejected from the recording head will not be adversely affected.

As a ninth mode, it is preferred that a recording apparatus according to any of the first aspect, the second, third, fourth, fifth, sixth, seventh, and eighth modes of the invention should further include: a carriage on which the recording head is mounted, the carriage reciprocating in the direction intersecting with the direction along which the recording target medium is transported; and an optical sensor that is provided on the carriage at a position where the optical sensor can face the first ribs, the optical sensor detecting an optical reflectance difference.

The first ribs are made of a resin material; in addition, the optical sensor is used for the sensing of the area where the first ribs are formed. Therefore, it is possible to obtain a good optical reflectance difference with respect to a recording target medium without any substantial increase in cost.

As a tenth mode, in a recording apparatus according to the ninth mode of the invention, it is preferred that the first rib should include an outside-detection-area rib portion, which is located outside a detection area of the optical sensor, and an inside-detection-area rib portion, which is located inside the detection area of the optical sensor; and a width of the inside-detection-area rib portion should be smaller than a width of the outside-detection-area rib portion.

In the preferred mode described above, the first rib includes a narrow rib portion inside the detection area of the optical sensor (inside-detection-area rib portion). With such a preferred structure, it is possible to prevent the optical sensor from erroneously detecting a part of the first rib as the side edge of a recording target medium when the side edge of the recording target medium and the first rib are close to each other. Alternatively, even when such a false detection occurs, it is possible to ensure that the error is small.

As an eleventh mode, in a recording apparatus according to the tenth mode of the invention, it is preferred that the first rib should be located at a position where the first rib supports an inside of a side edge of the recording target medium that has a predetermined size; and the inside-detection-area rib portion of the first rib that is located at the position should be formed under the recording target medium at a relatively inner area as viewed in a width direction with respect to the outside-detection-area rib portion.

In the preferred mode described above, since a narrow inside-detection-area rib portion that is formed near an edge of a recording target medium is located at an inner area that is relatively close to the center of the recording target medium, it is possible to prevent the false detection of the inside-detection-area rib portion as the edge of the recording target medium with greater reliability.

As a twelfth mode, in a recording apparatus according to any of the ninth, tenth, and eleventh modes of the invention, it is preferred that an area that can face the optical sensor between the first ribs provided in the direction intersecting with the direction along which the recording target medium is transported should have a pattern surface subjected to surface texturing, for example, crimp processed.

In the preferred mode described above, the area that can face the optical sensor between the first ribs provided in the direction intersecting with the direction along which the recording target medium is transported has a pattern surface subjected to surface texturing. This prevents mirror reflection between the first ribs. Therefore, it is possible to obtain a good optical reflectance difference with respect to the recording target medium and thus detect the width of the recording target medium properly.

A recording target medium transportation apparatus according to a thirteenth aspect of the invention includes: a plurality of first ribs provided on a transportation path along which a recording target medium is transported at predetermined intervals in a direction intersecting with a direction along which the recording target medium is transported, the plurality of first ribs being provided for guiding the recording target medium to a downstream side; and a plurality of second ribs provided at predetermined intervals in the direction intersecting with the direction along which the recording target medium is transported, the plurality of second ribs being provided downstream of the plurality of first ribs for guiding the recording target medium to the downstream side, the plurality of second ribs being provided at an area where the plurality of second ribs can face a recording head for recording on the recording target medium; wherein a first member on which the first ribs are formed is made of a resin material, and a second member on which the second ribs are formed is made of a metal material.

Since the second ribs for prescribing a distance between the recording head and the recording target medium is made of a metal material, the thirteenth aspect of the invention makes it possible to prevent the wear of the second ribs, thereby keeping high recording quality for a long period of time. Since the first ribs are made of a resin material, in a structure in which the optical sensor is used for the sensing of the area where the first ribs are formed, it is possible to obtain a good optical reflectance difference with respect to a recording target medium without any substantial increase in cost.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, an exemplary embodiment of the present invention will now be explained. The scope of the invention is not limited to the embodiment described below. The invention may be modified in various ways within the scope of the recitation of appended claims. An apparatus, etc. subjected to such a modification is also within the scope of the invention.

Figure 1:
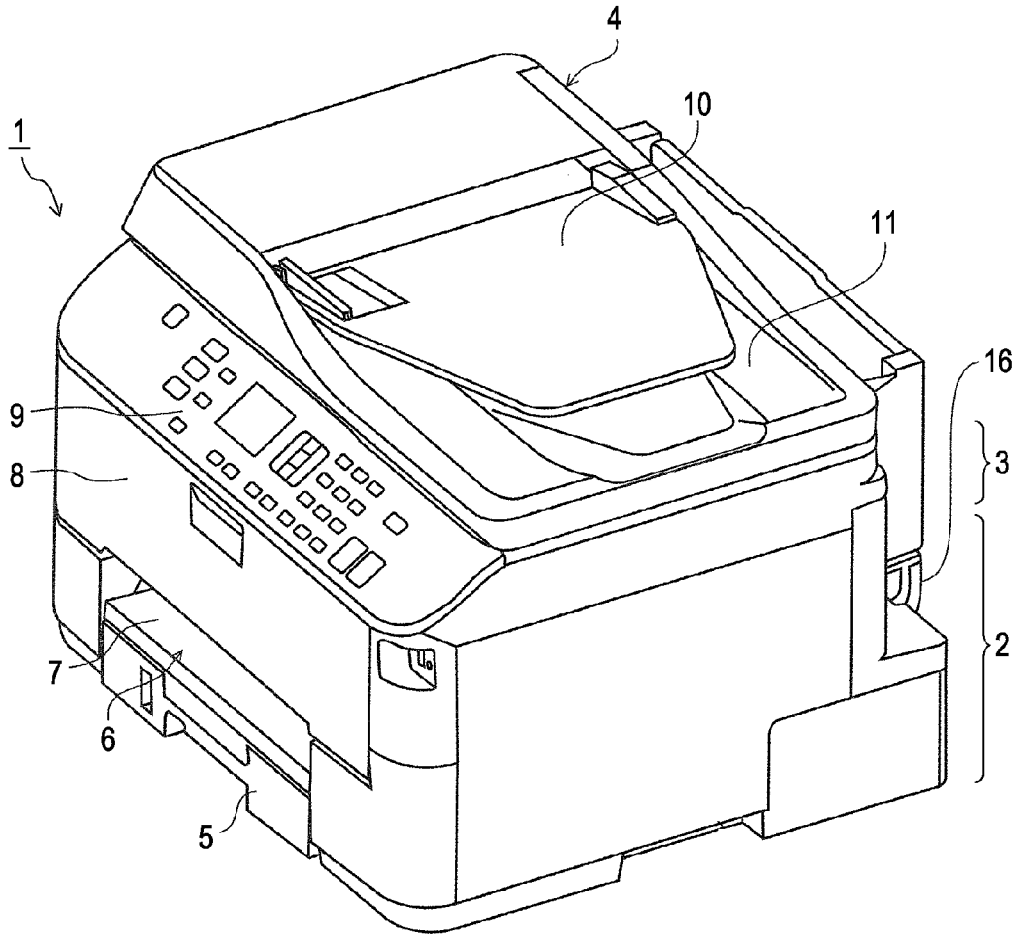
FIG. 1 is a perspective view that schematically illustrates an ink-jet printer according to an exemplary embodiment of the invention, which is observed from the front-side thereof.
Figure 2:
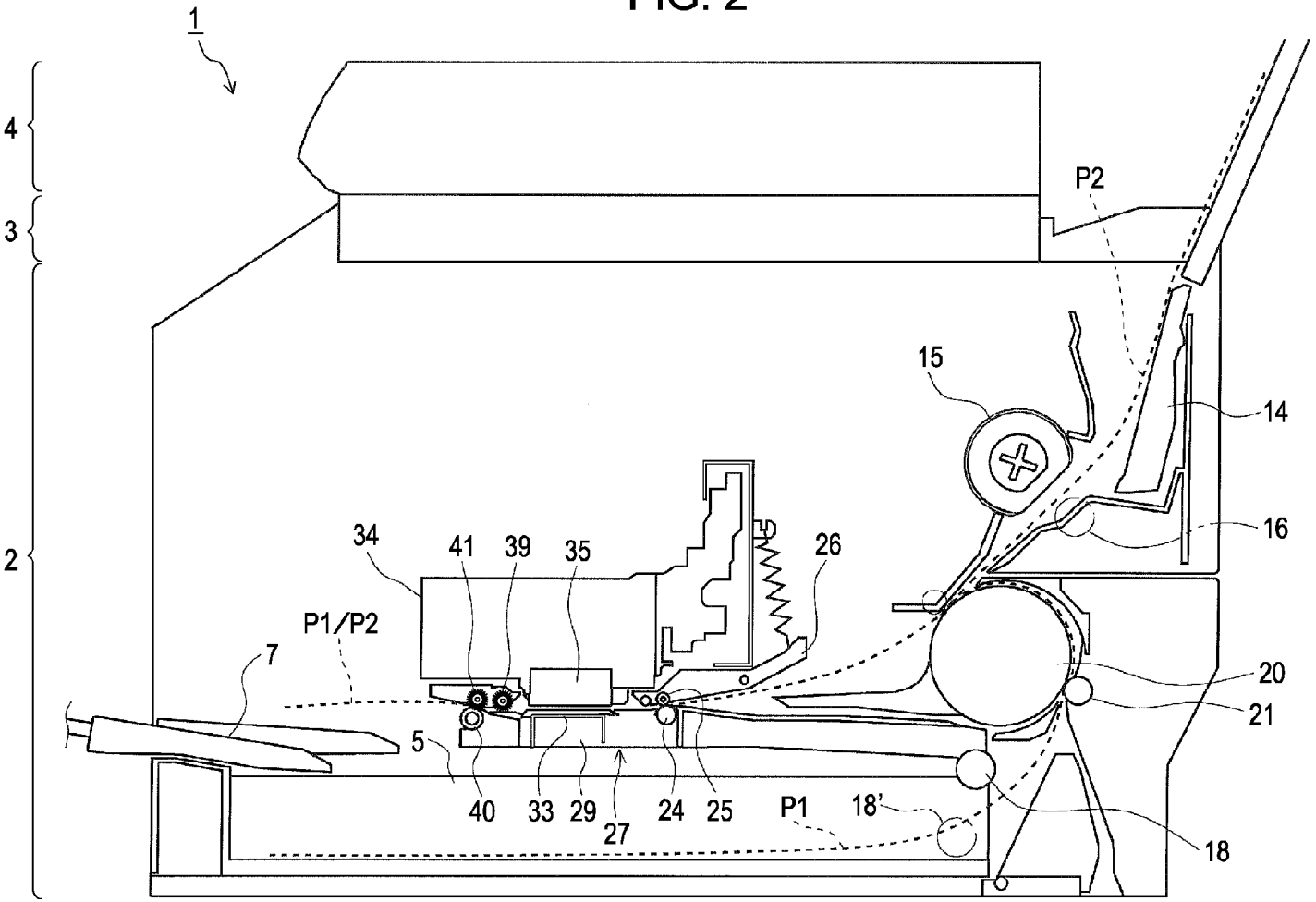
FIG. 2 is a side sectional schematic view of the ink-jet printer.
Figure 3:
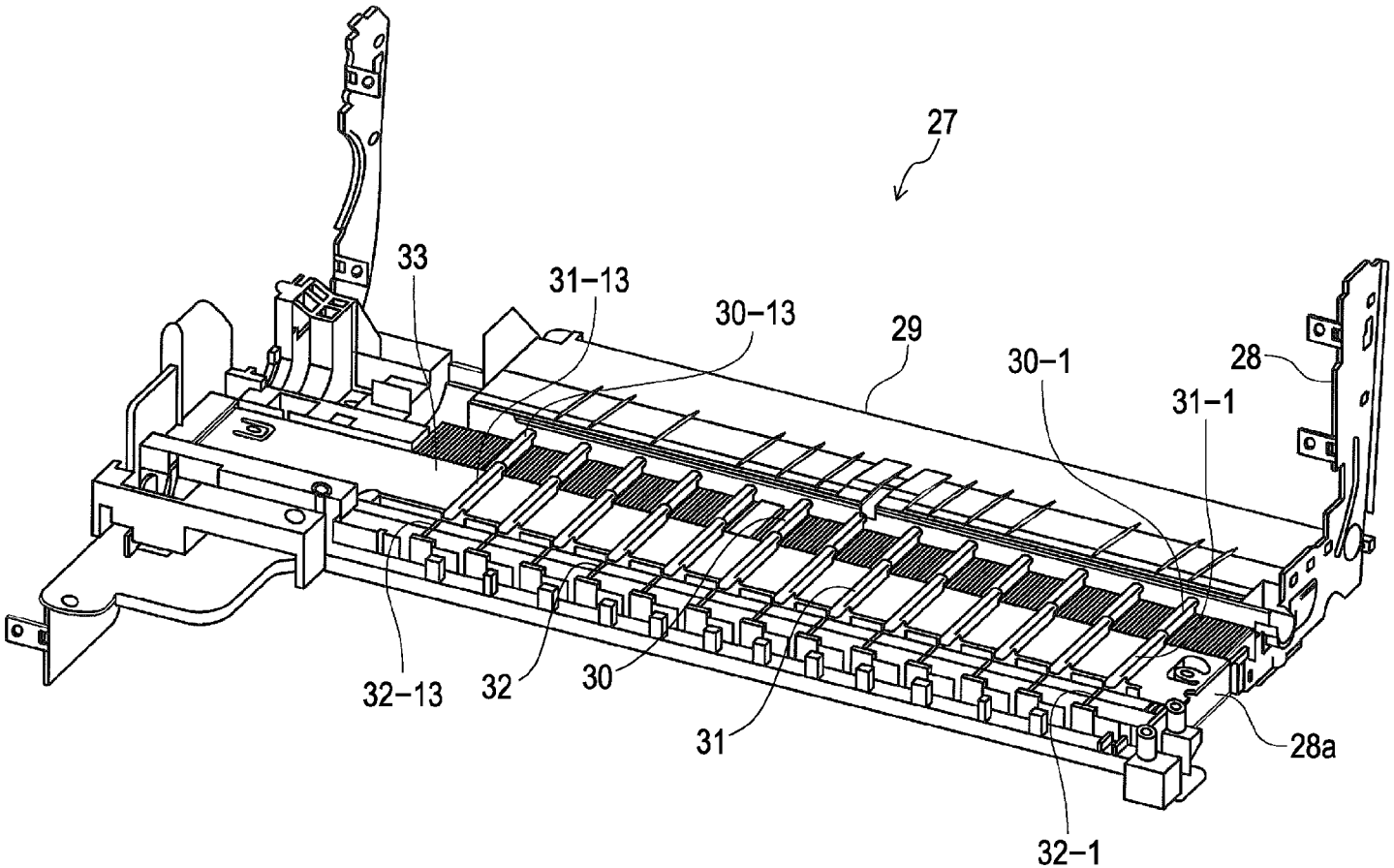
FIG. 3 is a perspective view that illustrates a supporting member Assy in an assembled state.
Figure 4:
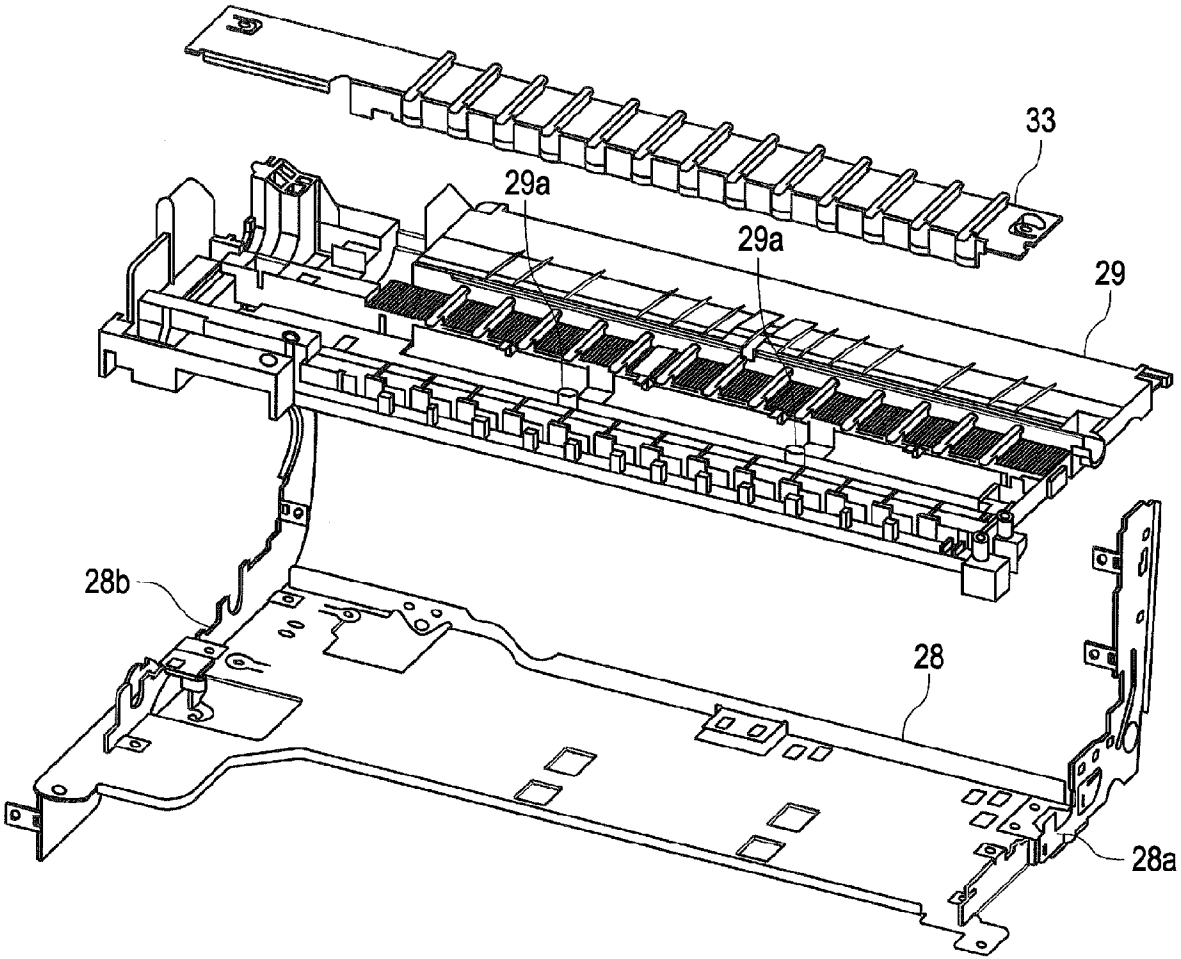
FIG. 4 is an exploded perspective view of the supporting member Assy.
Figure 5:
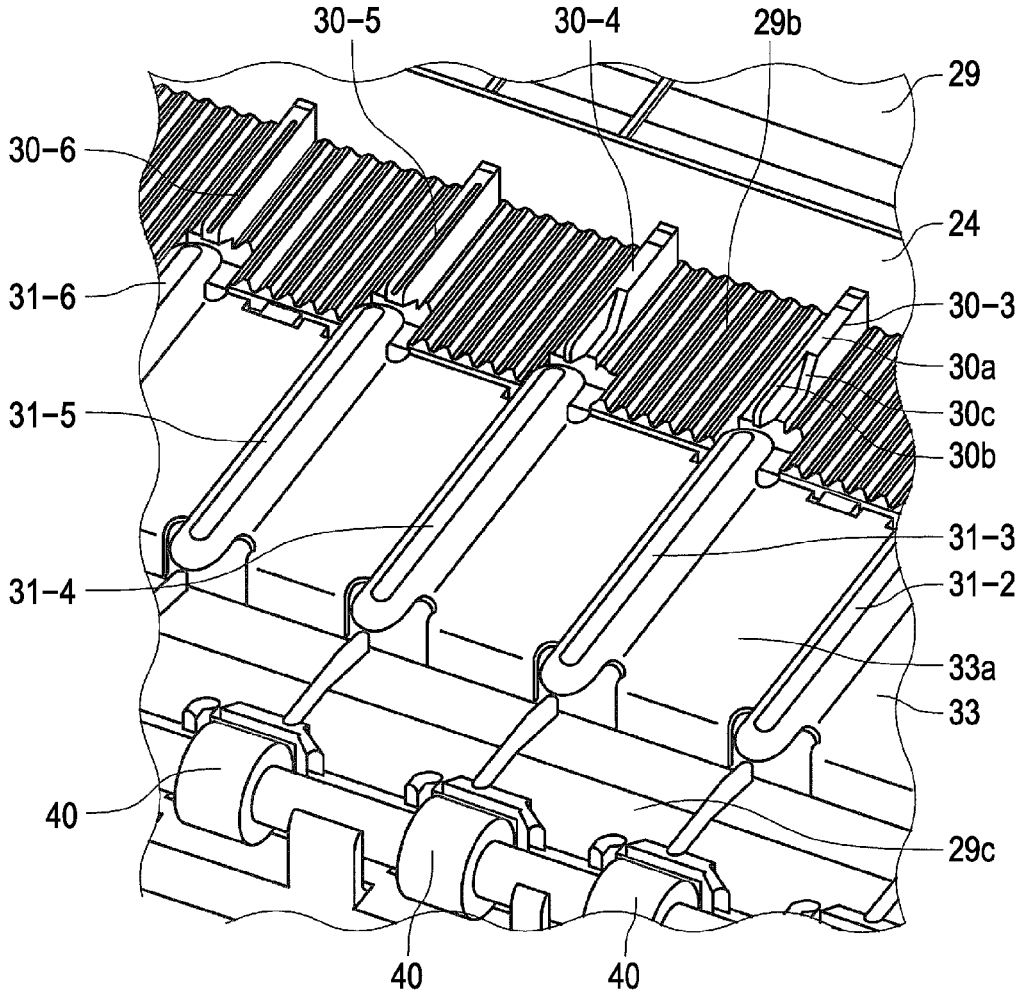
FIG. 5 is a partially enlarged perspective view of the supporting member Assy.
Figure 6:
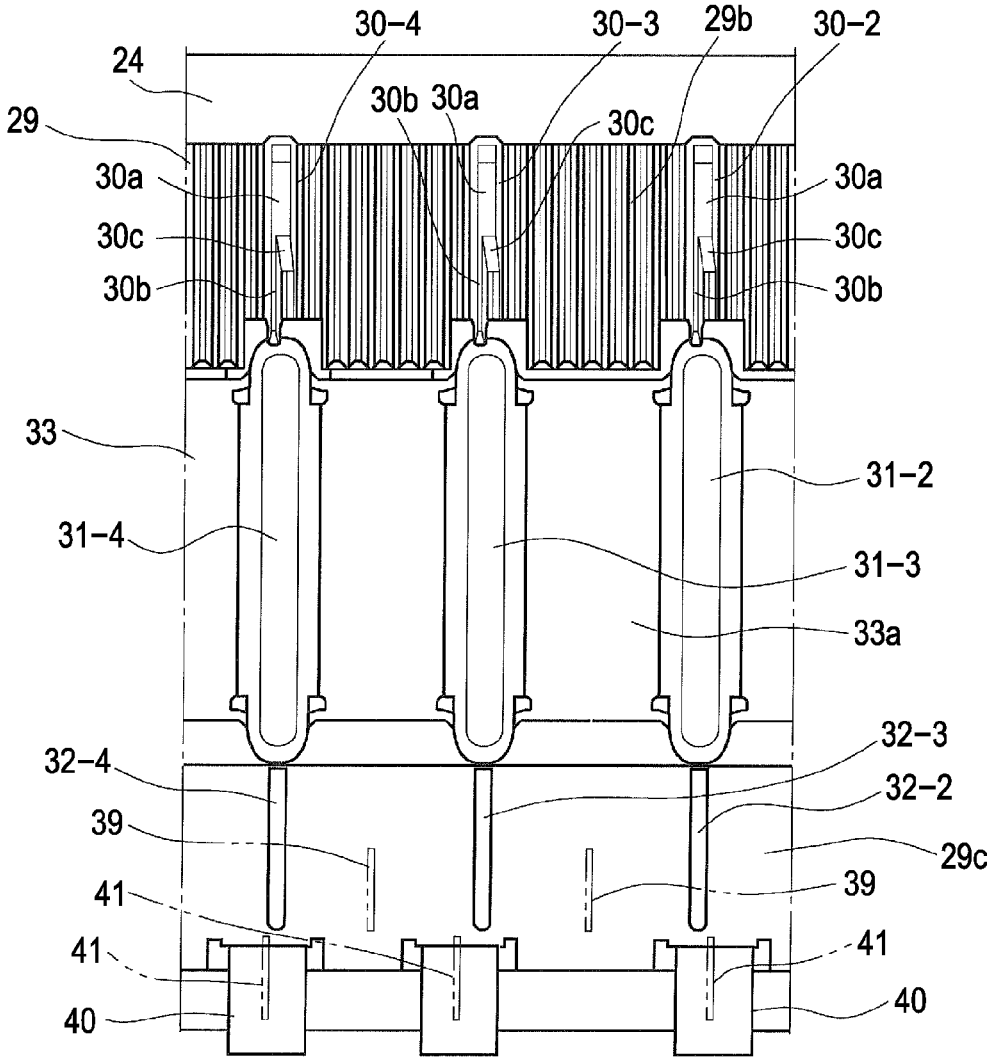
FIG. 6 is an enlarged plan view of a part of the supporting member Assy.
Figure 7:
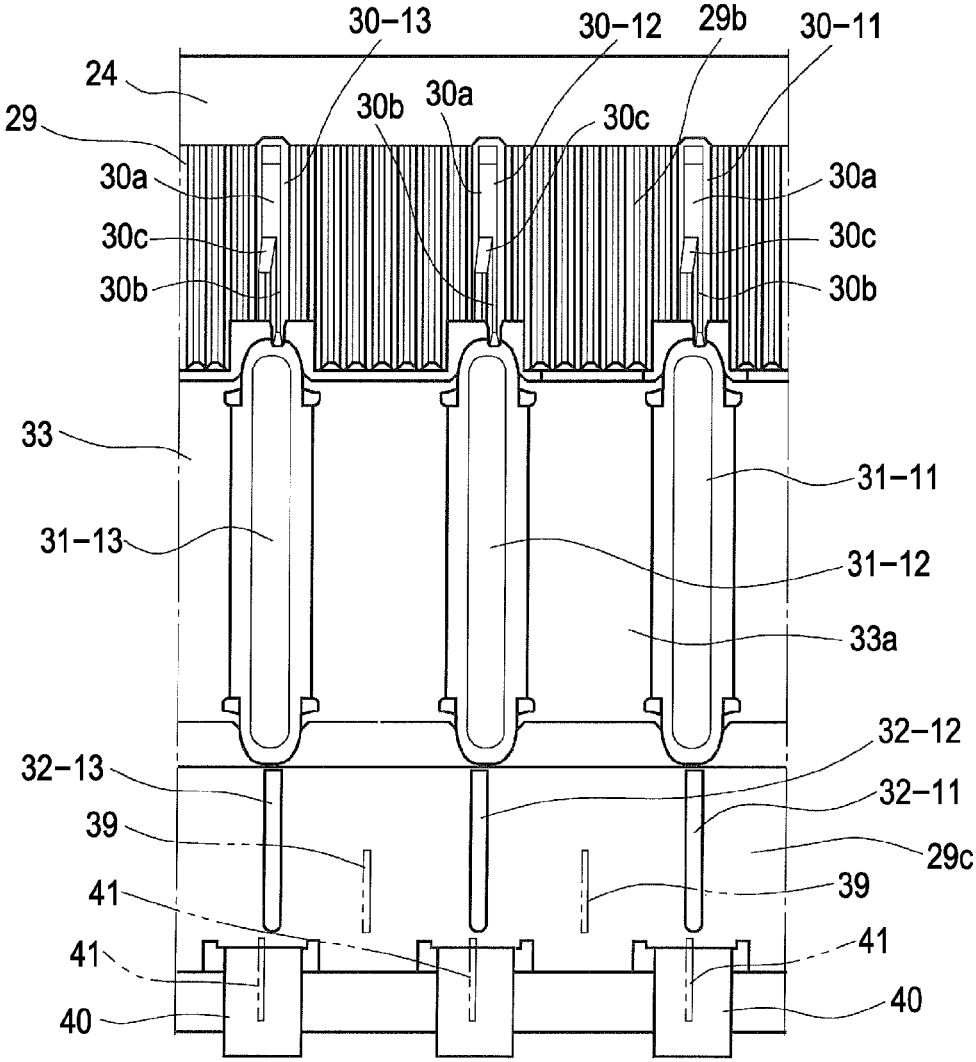
FIG. 7 is an enlarged plan view of another part of the supporting member Assy.
Figure 8A:
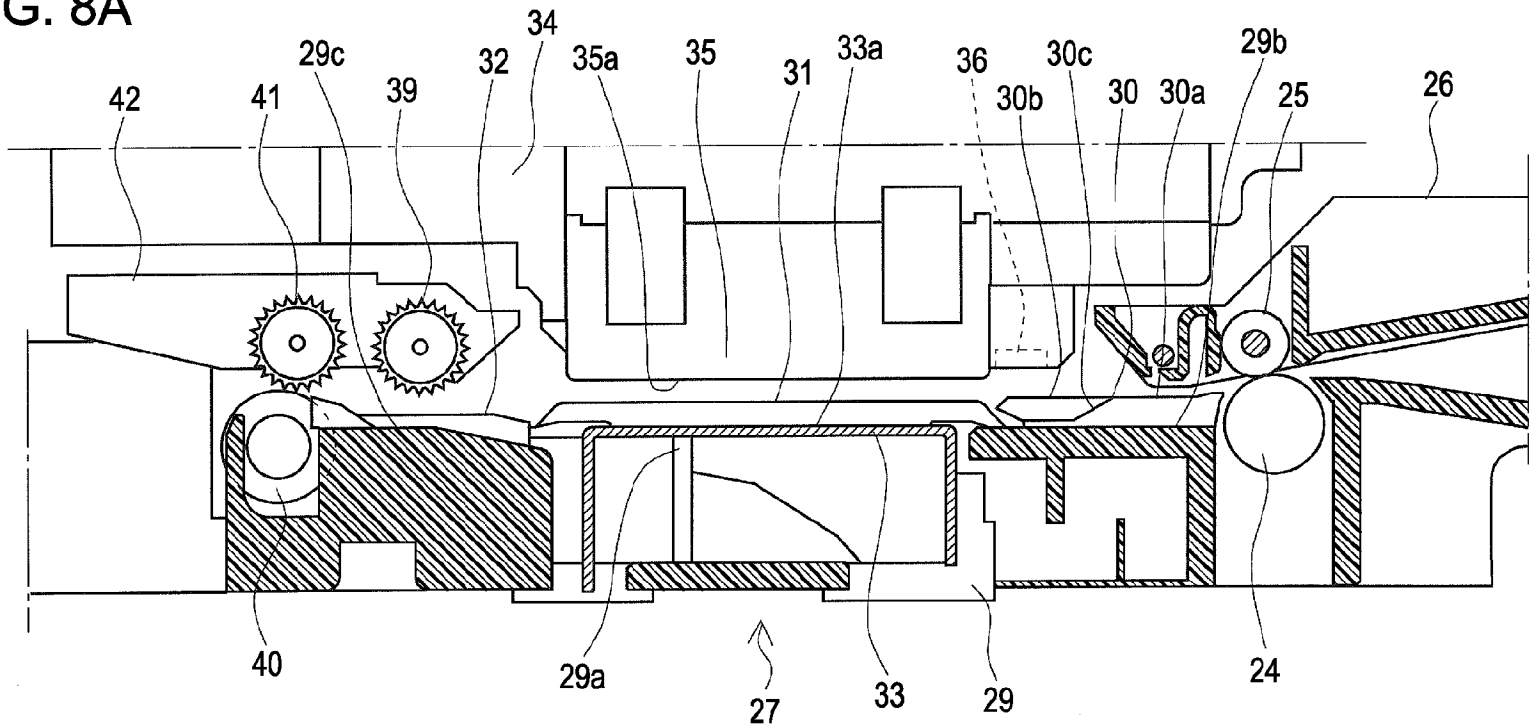
FIG. 8A is a side sectional view of the periphery of the supporting member Assy.
Figure 8B:
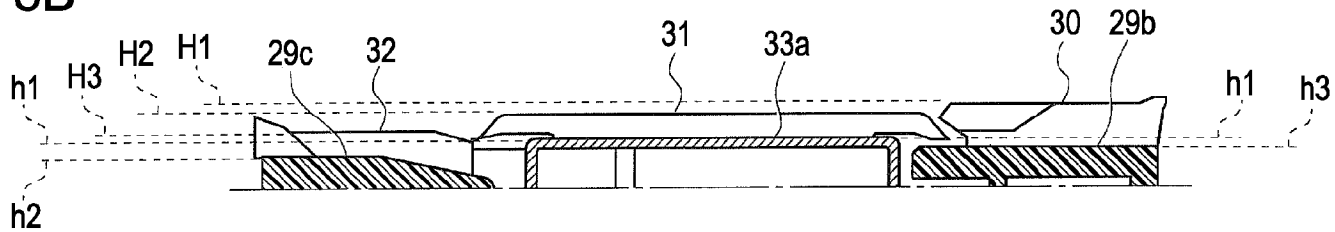
FIG. 8B is a side sectional view of the periphery of the supporting member Assy.
Figure 9A:
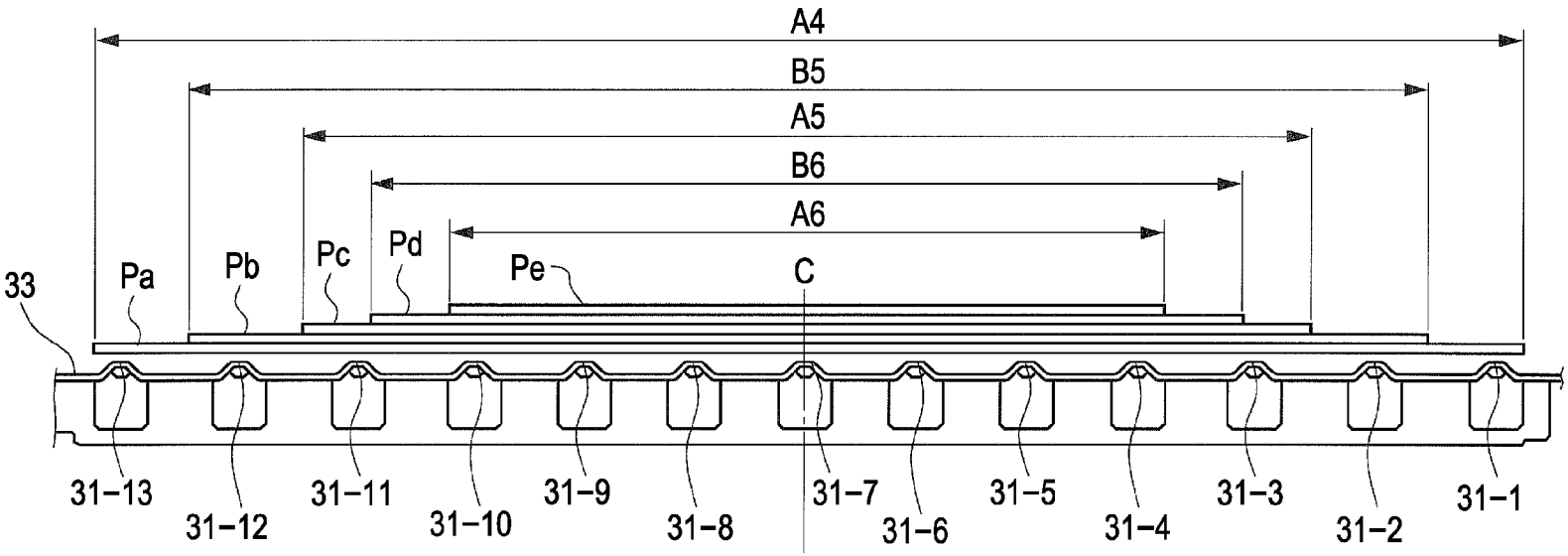
FIG. 9A is a diagram that illustrates a relationship between various paper sizes and the positions of second ribs.
Figure 9B:
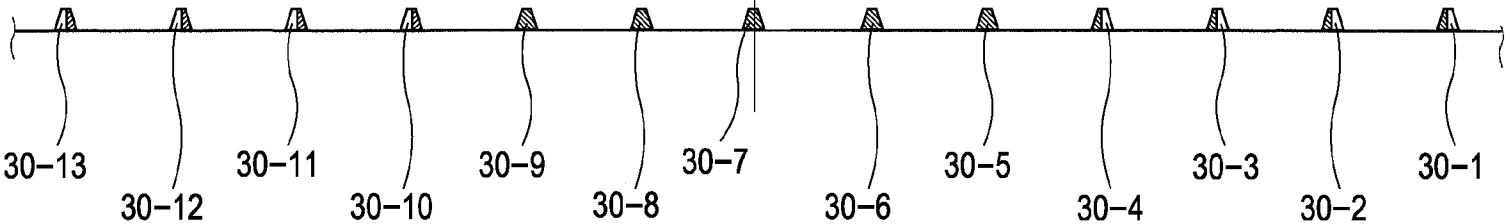
FIG. 9B is a diagram that illustrates a relationship between various paper sizes and the shape of first ribs.

FIG. 1 is a perspective view that schematically illustrates a recording apparatus according to an aspect of the present invention, which is observed from the front-side of the apparatus. More specifically, an ink-jet printer 1 is illustrated therein as an example of the recording apparatus. FIG. 2 is a side sectional schematic view of the ink-jet printer 1. FIG. 3 is a perspective view that illustrates a supporting member Assy 27 in an assembled state. FIG. 4 is an exploded perspective view of the supporting member Assy 27. FIG. 5 is a partially enlarged perspective view of the supporting member Assy 27. FIG. 6 is an enlarged plan view of a part of the supporting member Assy 27. FIG. 7 is an enlarged plan view of another part of the supporting member Assy 27. FIG. 8A, 8B is a side sectional view of the periphery of the supporting member Assy 27. FIG. 9A is a diagram that illustrates a relationship between various paper sizes and the positions of second ribs 31. FIG. 9B is a diagram that illustrates a relationship between various paper sizes and the shape of first ribs 30.

First of all, the overall structure of the ink-jet printer 1 will now be briefly explained. In FIG. 1, the reference numeral 2 denotes an ink-jet recording unit that is used for recording on a sheet of paper. The reference numeral 3 denotes a scanning unit that is provided over the recording unit 2. The reference numeral 4 denotes an automatic document feed unit that is provided over the scanning unit 3. That is, the ink-jet printer 1 is configured as a multi-function printer that is provided with a scanning function in addition to an ink-jet recording function.

The reference numeral 5 denotes a detachable paper cassette provided at the front of the body of the apparatus. Sheets of recording paper can be loaded in the paper cassette 5. The reference numeral 6 denotes a paper ejection port formed at the front of the apparatus body. After the completion of recording, paper is ejected at the paper ejection port 6. The reference numeral 7 denotes an ejection tray provided at the front of the apparatus body. The ejection tray 7 receives ejected paper.

The reference numeral 8 denotes a front cover that can be opened to expose a paper transportation path when a paper jam failure has occurred. The reference numeral 9 denotes an operation panel that includes a power button, operation buttons for various print settings and executing recording, a display unit for, for example, print-setting display and print image preview display, though not limited thereto. The reference numeral 10 denotes a tray for setting an original document. The reference numeral 11 denotes a tray for receiving the original document when it is ejected. The original-setting tray 10 and the original-receiving tray 11 are provided at the top of the apparatus body.

Next, with reference to FIG. 2, paths along which paper can be transported inside the recording unit 2 will now be briefly explained. Note that FIG. 2 is a schematic view of the structure of the recording unit 2 and thus does not show all of components thereof. Components that do not have to be mentioned for giving the following explanation are not shown therein.

The recording unit 2 has two paper-feeding paths. One of the two paths leads from the paper cassette 5, which is provided at the bottom of the apparatus body. The other path leads from a supporting member 14, which is provided at the back of the apparatus body (the right-hand side in FIG. 2). A broken-line curve P1 shows a route along which paper fed from the paper cassette 5 moves. A broken-line curve P2 shows a route along which paper fed from the supporting member 14 moves.

The reference numeral 18 denotes a feeding roller, which is provided opposite to the paper cassette 5. The feeding roller 18 is configured as a retractable roller that can be moved closer to and away from the paper cassette 5 as shown by a virtual-line circle (which is denoted as 18') and a solid circle. The feeding roller 18 is brought into contact with the uppermost one of sheets of recording paper loaded in the paper cassette 5 and is then rotated, thereby picking up the uppermost sheet and feeding it to the downstream side. The fed sheet of recording paper moves along the circumferential surface of a turnover roller 20, which has a large diameter in cross section. In this process, the turnover roller 20 turns over the sheet, which is being transported while making a curve along the circumferential surface, to reverse its direction. After the above turnover, the sheet arrives at a transportation driven roller 25 and a transportation driving roller 24 functioning as a transporting means. The reference numeral 21 denotes a separation roller. Paper is nipped at a gap between the turnover roller 20 and the separation roller 21 for sheet separation.

The supporting member 14 supports sheets of paper in a reclining position. The supporting member 14 has a turning shaft that is not shown at its upper part. The supporting member 14 turns around the turning shaft to bring the uppermost one of the sheets of paper supported by the supporting member 14 into contact with a feeding roller 15. The feeding roller 15 rotates to feed the sheet of paper that is in contact therewith to the downstream side. The reference numeral 16 denotes a separation roller. Paper is nipped at a gap between the feeding roller 15 and the separation roller 16 for sheet separation.

Functioning as a pair of rollers, the transportation driving roller 24 and the transportation driven roller 25 transport paper to the downstream side with high precision. An ink-jet recording head 35 and a supporting member Assy 27 are provided opposite to each other downstream of the pair of rollers. The supporting member Assy 27 functions as a recording target medium guiding apparatus for guiding paper to the downstream side.

The recording head 35 is provided at the bottom of a carriage 34. The carriage 34 can reciprocate in the direction orthogonal to the direction along which paper is transported. The carriage-reciprocating direction orthogonal to the paper transportation direction corresponds to the direction perpendicular to the sheet face on the front/back side of FIG. 2, 8 and to the horizontal direction in FIG. 6, 7. This direction is hereinafter referred to as "main scan direction". While moving in the main scan direction, the ink-jet recording head 35 ejects ink so as to perform recording on paper.

The supporting member Assy 27 is an assembled member that includes a first member 29 and a second member 33. First ribs 30, second ribs 31, and third ribs 32 that will be described later are formed on the upper surface thereof. These ribs are configured to support paper and guide it to the downstream side. As illustrated therein, the second ribs 31 are arranged in an area where they can face the recording head 35.

The reference numeral 39 denotes a driven roller that is provided downstream of the recording head 35 and prevents the rising of a part of paper. The reference numeral 40 denotes an ejection driving roller that is provided downstream of the driven roller 39 and rotates to eject paper. The reference numeral 41 denotes an ejection driven roller that is also provided downstream of the driven roller 39. Paper is nipped at a gap between the ejection driving roller 40 and the ejection driven roller 41. Functioning as a pair of rollers, the ejection driving roller 40 and the ejection driven roller 41 ejects paper onto the ejection tray 7 after the completion of recording operation. In the present embodiment of the invention, the ejection driving roller 40 is a rubber roller, whereas the ejection driven roller 41 is a serrated roller, which has a large number of teeth at its circumferential part. The driven roller 39 is also a serrated roller.

The ink-jet printer 1 can back-feed a sheet of paper on the front (first surface) of which recording operation has now been performed, instead of ejecting the sheet onto the ejection tray 7, and then cause its turnover roller 20 to turn over the sheet. By this means, the ink-jet printer 1 can perform recording operation on the back (second surface) of the sheet.

The foregoing is a brief explanation of the structure of the ink-jet printer 1. Next, with reference to FIG. 3 and subsequent drawings, the supporting member Assy 27 will now be explained in detail.

As illustrated in FIGS. 3 and 4, the supporting member Assy 27 is an assembled member that is made up of the first member 29, the second member 33, and a frame 28. The two ends of the first member 29 are attached to the side frame portions 28*a* and 28*b* of the frame 28 respectively by using fixing means (not shown) such as screws. The two ends of the second member 33 are also attached thereto respectively by using the fixing means.

The first member 29 is elongated in the main scan direction. The second member 33 is also elongated in the main scan direction. The first member 29 is made of a resin material (by molding). The second member 33 is made of a metal plate material (by drawing). A supporting portion 29*a* (refer to FIGS. 4 and 8) is formed on the first member 29 at each of two places between the two ends thereof. The second member 33 is supported at the two places by the respective supporting portions 29*a* in addition to its two ends. This prevents the deflection of the second member 33 in the main scan direction.

The first ribs 30 and the third ribs 32 for guiding paper to the downstream side are formed on the first member 29. More specifically, the first ribs 30 and the third ribs 32 are formed integrally on the first member 29 at predetermined regular intervals in the main scan direction. The second ribs 31 for guiding paper to the downstream side are formed on the second member 33. More specifically, the second ribs 31 are formed integrally on the second member 33 at predetermined regular intervals in the main scan direction. Each of these ribs has a shape extending in the direction along which paper is transported.

Another feature of the arrangement of these ribs is as follows. The first ribs 30, which are the most upstream ribs in the present embodiment of the invention, are located at positions where they can face an optical sensor 36 provided at the bottom of the carriage 34 as illustrated in FIG. 8 as the carriage 34 moves. The second ribs 31, which are provided downstream of the first ribs 30, are located at positions where they can face the recording head 35 as the carriage 34 moves.

The optical sensor 36 includes a light-emitting portion (not shown) and a light-receiving portion (not shown). The optical sensor 36 can detect an optical reflectance difference on the first member 29 by emitting light to the first member 29 and then receiving reflected light.

Next, the arrangement of the transportation driving roller 24 and the transportation driven roller 25, which constitute a pair of roller that is provided upstream of the first ribs 30, will now be explained. The center of rotation of the transportation driven roller 25 is located slightly downstream of the center of rotation of the transportation driving roller 24 so as to orient the paper-feeding direction toward the first ribs 30. Therefore, paper is transported to the downstream side while being pressed against the each of the ribs.

Since the supporting member Assy 27 has the structure explained above, ups and downs due to corrugation called as cockling will be formed along the main scan direction after the ejection of ink from the recording head 35 especially when paper that has low stiffness is used because of a sag at each of gaps between the ribs. Thanks to the above structure, there will be regularity in swelling caused by the absorption of ink. Therefore, it is possible to avoid serious irregularity in a paper gap in the main scan direction. In order to facilitate proper cockling, the assisting roller 39 is disposed approximately at the midpoint between each two adjacent ribs in the main scan direction (refer to FIGS. 6 and 7). In addition, both the ejection driving roller 40 and the ejection driven roller 41 are disposed at positions that are substantially the same as the positions of the ribs as viewed in the main scan direction (refer to FIGS. 6 and 7).

In FIGS. 3 to 7 and 9, the first ribs 30 that are formed in a line along the main scan direction are indicated with adscripts (30-1, 30-2, . . . , 30-13) for the purpose of distinguishing one from another. In like manner, the second ribs 31 are indicated with adscripts (31-1, 31-2, . . . , 31-13) for the purpose of distinguishing one from another. The third ribs 32 are also indicated with adscripts (32-1, 32-2, . . . , 32-13) for the purpose of distinguishing one from another. Notwithstanding the above, the term "first ribs 30", "second ribs 31", and "third ribs 32" will be used each as a collective name for a plurality of ribs formed in a line along the main scan direction in the following part of this specification as in the foregoing part thereof where it is not necessary to distinguish one from another.

Next, some features of the supporting member Assy 27 will now be explained in detail. Working effects for each of the features will also be explained.

First Feature of Supporting Member Assy 27

As described above, the second member 33 on which the second ribs 31 are formed is made of a metal material (in the present embodiment of the invention, a galvanized steel sheet). That is, the second ribs 31 for prescribing a distance between the recording head 35 and paper is made of a metal material. Therefore, it is possible to avoid a change in a paper gap or the position/attitude, etc. of paper due to the wear of the second ribs 31, thereby keeping high recording quality for a long period of time.

Though the first ribs 30 are made of a resin material, they are formed outside an area facing the recording head 35. Therefore, even when the first ribs 30 wear, it has almost no effect on the gap between the recording head 35 and paper. Thus, recording quality is not affected.

The first member 29, on which the first ribs 30 are formed, is made of a resin material; in addition, the optical sensor 36 is used for the sensing of the area where the first ribs 30 are formed. Therefore, it is possible to obtain a good optical reflectance difference between it and paper without any substantial increase in cost.

Second Feature of Supporting Member Assy 27

In the present embodiment of the invention, the first ribs 30 are made of a black resin. In addition, as illustrated in FIGS. 6 and 7, fine convexes and concaves are formed in a first-rib forming surface 29*b* between the first ribs 30. Since the convex-and-concave pattern prevents mirror reflection at the first-rib forming surface 29*b*, it is possible to obtain a good optical reflectance difference between it and paper having a high reflection factor (white paper). Though fine convexes and concaves are formed in the first-rib forming surface 29*b* in the present embodiment of the invention as described above, a modified structure for low reflection may be adopted. For example, the surface may be crimp processed for ensuring low reflection.

Third Feature of Supporting Member Assy 27

The second member 33 has a symmetrical shape as viewed in the direction along which paper is transported (vertical direction in FIGS. 6 and 7). The symmetrical structure makes internal stress exerted in a material during the process of drawing uniform and thus reduces deflection, thereby preventing a gap between the recording head 35 and paper from becoming uneven to end up adversely affecting recording quality.

Fourth Feature of Supporting Member Assy 27

FIG. 8B is a diagram for explaining a relationship between the height of the first rib 30, the height of the second rib 31, the height of the third rib 32, the height of the first-rib forming surface 29*b*, the height of a second-rib forming surface 33*a*, and the height of a third-rib forming surface 29*c* (distance to the recording head 35). Note that the difference in height is slightly exaggerated therein as compared with that shown in FIG. 8A. The reference numerals H1, H2, and H3 denote the height of the first rib 30, the height of the second rib 31, the height of the third rib 32, respectively. The reference numerals h1, h2, and h3 denote the height (level) of the second-rib forming surface 33*a*, and the height of the third-rib forming surface 29*c*, and the height of the first-rib forming surface 29*b*, respectively.

In the present embodiment of the invention, as illustrated in FIG. 8B, the height of the first rib 30 is greater than that of the second rib 31. In addition, the height of the second rib 31 is greater than that of the third rib 32. The above structure produces the following working effects.

When ink is ejected onto paper, the recording-side surface of the paper gets swollen. Therefore, the paper tends to form into a convex shape toward the top of FIG. 8. When the leading edge of paper that is in such a state moves over the ribs, the leading edge would raise itself if the surface of an upstream-side rib and the surface of a downstream-side rib were at the same level. This would make a gap between the recording head 35 and the paper improper.

As described above, in the present embodiment of the invention, the surface level of a downstream-side rib is lower than that of an upstream-side rib. Therefore, when the leading edge of paper moves over the first rib 30, the second rib 31, and the third rib 32 in this order, the rising of the leading edge of the paper does not occur.

Fifth Feature of Supporting Member Assy 27

In the present embodiment of the invention, as illustrated in FIG. 8B, the level of the second-rib forming surface 33*a* is higher than that of the first-rib forming surface 29*b* and, in addition, is higher than that of the third-rib forming surface 29*c*. Since the recording apparatus has such a structure, the first-rib forming surface 29*b* and the third-rib forming surface 29*c*, both of which are formed by using a resin material and are easily charged with electricity, are located at a relatively long distance from the recording head 35 as compared with a distance between the recording head 35 and the second-rib forming surface 33*a*, which is formed by using a metal material and is not easily charged with electricity. This prevents the generation of an intense electric field between the recording head 35 and the surface and thus prevents adverse effects on the landing precision of ink ejected from the recording head 35.

Sixth Feature of Supporting Member Assy 27

The recording head 35 has a surface that faces the second ribs 31 (plate surface). In the present embodiment of the invention, the plate surface 35*a* is made of a metal material. The plate surface 35*a* and the second member 33 are set at the same electric potential through ground connection. The above structure prevents the generation of an electric field between the recording head 35 and the second member 33, thereby ensuring that the landing precision of ink ejected from the recording head 35 will not be adversely affected.

Seventh Feature of Supporting Member Assy 27

In the present embodiment of the invention, as illustrated in FIGS. 5, 6, and 7, the first rib 30 includes an outside-detection-area rib portion 30*a*, which is located outside the detection area of the optical sensor 36, and an inside-detection-area rib portion 30*b*, which is located inside the detection area of the optical sensor 36. The width of the inside-detection-area rib portion 30*b* is smaller than that of the outside-detection-area rib portion 30*a*.

With such a structure, it is possible to prevent the optical sensor 36 from erroneously detecting a part of the first rib 30 as the side edge of paper when the side edge of the paper and the first rib 30 are close to each other. Alternatively, even when such a false detection occurs, it is possible to ensure that the error is small.

The following is a more detailed explanation of the above feature of the supporting member Assy 27. FIG. 9A is a diagram that illustrates a relationship between the edge positions of sheets corresponding to various paper sizes including A4, B5, A5, B6, and A6 (paper Pa, Pb, Pc, Pd, and Pe) and the positions of the second ribs 31-1 to 31-13. FIG. 9B is a diagram that illustrates a relationship between the sheets corresponding to the above various paper sizes and the positions of the first ribs 30-1 to 30-13. The center of paper is shown as a position C.

For example, let us suppose that the A4 paper Pa is used. Since the first ribs 30-1 and 30-13 are located slightly inside the respective side edges of the paper Pa, there is a risk that the top of the first rib 30-1, 30-13 might be recognized as the edge of the paper Pa due to false detection when the position of the paper Pa is slightly shifted. However, since the inside-detection-area rib portion 30*b*, which is located inside the detection area of the optical sensor 36, has a smaller rib width as described above, it is possible to prevent the false detection described above.

In FIG. 9B, each hatched portion represents a cross-sectional portion. Not all of the first ribs 30 that are formed in a line along the main scan direction include the inside-detection-area rib portion 30*b*; as illustrated therein, it is the first ribs 30-1 to 30-4 located at one side and the first ribs 30-10 to 30-13 located at the other side that include the inside-detection-area rib portion 30*b*. The inside-detection-area rib portion 30*b* is not formed in any of the center-side first ribs 30-5 to 30-9 (refer to FIG. 5 in addition to FIG. 9). Each of the center-side first ribs 30-5 to 30-9 has a constant rib width as viewed in the direction along which paper is transported. This is because the problem of false detection described above does not arise when there is a sufficient distance from an edge of paper.

Eighth Feature of Supporting Member Assy 27

As illustrated in FIGS. 6, 7, and 9B, each inside-detection-area rib portion 30*b* is formed at an inner area that is relatively close to the center of paper as viewed in the width direction of the corresponding outside-detection-area rib portion 30*a*. For example, as illustrated in FIG. 6, the inside-detection-area rib portion 30*b* of each of the first ribs 30-2, 30-3, and 30-4 is formed at a left-side area only (inner area that is relatively close to the center of paper) with respect to the corresponding outside-detection-area rib portion 30*a* (note that the same holds true for the first rib 30-1, which is not shown in FIG. 6). As illustrated in FIG. 7, the inside-detection-area rib portion 30*b* of each of the first ribs 30-11, 30-12, and 30-13 is formed at a right-side area only (inner area that is relatively close to the center of paper) with respect to the corresponding outside-detection-area rib portion 30*a* (note that the same holds true for the first rib 30-10, which is not shown in FIG. 7). Since the inside-detection-area rib portion 30*b* is formed as described above, it is possible to prevent the aforementioned false detection with greater reliability.

Ninth Feature of Supporting Member Assy 27

In the present embodiment of the invention, the width of the second rib 31 is larger than that of the first rib 30 (refer to FIGS. 6 and 7). The above structure produces the following working effects. When paper is fed back for the purpose of duplex recording on both surfaces thereof, there is a risk that the rear edge of the paper might get snagged on the first ribs 30 when it is transported from the second ribs 31 to the first ribs 30.

However, since the width of the second rib 31 is larger than that of the first rib 30, relatively large curves (cockling) will be formed in paper at the second ribs 31. This prevents the rear edge of the paper from getting snagged on the first ribs 30 when it is transported from the second ribs 31 to the first ribs 30. In addition, in the present embodiment of the invention, the width of the second rib 31 is larger than that of the third rib 32. When recording operation is performed on one side of paper, since the width of the second rib 31 is larger than that of the third rib 32, relatively large curves will be formed in the paper at the second ribs 31. This prevents the leading edge of the paper from getting snagged on the third ribs 32 when it is transported from the second ribs 31 to the third ribs 32.

As illustrated in FIGS. 5 and 8, an inclined surface 30*c* is formed in each of ribs that include both the outside-detection-area rib portion 30*a* and the inside-detection-area rib portion 30*b*. Therefore, when the rear edge of paper moves to the upstream side (to the right in FIG. 8) along the surface of the first ribs 30, it does not get snagged on the outside-detection-area rib portion 30*a*, meaning that it can move smoothly.

Needless to say, the exemplary embodiment described above is a mere example; the scope of the invention is not limited thereto. Each feature described in the foregoing embodiment can be implemented as an independent invention.

The entire disclosure of Japanese Patent Application No. 2011-42262, filed Feb. 28, 2011 is expressly incorporated by reference herein.

What is claimed is:

1. A recording apparatus comprising:

a transportation path along which a recording target medium is transported;

a recording head for recording on the recording target medium;

a pair of transportation rollers provided upstream of the recording head;

a pair of ejection rollers provided downstream of the recording head;

a plurality of first ribs provided on the transportation path at predetermined intervals in a direction intersecting with a direction along which the recording target medium is transported;

a plurality of second ribs provided at predetermined intervals in the direction intersecting with the direction along which the recording target medium is transported, the plurality of second ribs being provided downstream of the plurality of first ribs for guiding the recording target medium to a downstream side, the plurality of second ribs being provided at an area where the plurality of second ribs can face the recording head;

a first member that is made of a resin material that is used as a material of the plurality of first ribs;

a second member that is made of a metal material that is used as a material of the plurality of second ribs;

a carriage on which the recording head is mounted, the carriage reciprocating in the direction intersecting with the direction along which the recording target medium is transported; and an optical sensor that is provided on the carriage at a position where the optical sensor can face the first ribs, the optical sensor detecting an optical reflectance difference, wherein the plurality of first ribs and the plurality of second ribs are provided between the pair of transportation rollers and the pair of ejection rollers, wherein the first member has a plurality of convexes which are provided between the plurality of the first ribs wherein the plurality of the convexes are lower than the first ribs, and are continuously formed in a region between the adjoined first ribs.

2. The recording apparatus according to claim 1, further comprising a plurality of third ribs provided at predetermined intervals in the direction intersecting with the direction along which the recording target medium is transported, the plurality of third ribs being provided downstream of the plurality of second ribs and being rovided between the pair of the transportation rollers and the pair of the ejection rollers for guiding the recording target medium to the downstream side, the plurality of third ribs being made of the resin material.

3. The recording apparatus according to claim 2, wherein a height of the first rib is greater than a height of the second rib, and the height of the second rib is greater than a height of the third rib.

4. The recording apparatus according to claim 2, wherein the first ribs are formed on a first-rib forming surface of the first member; the second ribs are formed on a second-rib forming surface of the second member; the third ribs are formed on a third-rib forming surface of the first member; and a level of the second-rib forming surface is higher than a level of the first-rib forming surface and, in addition, is higher than a level of the third-rib forming surface.

5. The recording apparatus according to claim 2, wherein a width of the second rib is larger than a width of the first rib and is larger than a width of the third rib.

6. The recording apparatus according to claim 1, wherein a width of the second rib is larger than a width of the first rib.

7. The recording apparatus according to claim 1, further comprising a frame member that supports the first member at two ends thereof in the direction intersecting with the direction along which the recording target medium is transported and supports the second member at two ends thereof in the direction intersecting with the direction along which the recording target medium is transported, wherein the second member is supported somewhere between the two ends by the first member.

8. The recording apparatus according to claim 1, wherein the recording head and the second member are set at the same electric potential.

9. The recording apparatus according to claim 1, wherein the first rib includes an outside-detection-area rib portion, which is located outside a detection area of the optical sensor, and an inside-detection-area rib portion, which is located inside the detection area of the optical sensor; and a width of the inside-detection-area rib portion is smaller than a width of the outside-detection-area rib portion.

10. The recording apparatus according to claim 9, wherein the first rib is located at a position where the first rib supports an inside of a side edge of the recording target medium that has a predetermined size; and the inside-detection-area rib portion of the first rib that is located at the position is formed under the recording target medium at a relatively inner area as viewed in a width direction with respect to the outside-detection-area rib portion.

11. The recording apparatus according to claim 1, wherein an area that can face the optical sensor between the first ribs provided in the direction intersecting with the direction along which the recording target medium is transported has a pattern surface subjected to surface texturing.

12. A recording apparatus comprising:

a transportation path provided in a first direction along which a recording target medium is transported;

a carriage on which a recording head is mounted, the carriage reciprocating in a second direction intersecting with the first direction along which the recording target medium is transported;

a pair of transportation rollers provided upstream of the recording head;

a pair of ejection rollers provided downstream of the recording head;

an optical sensor which is provided on the carriage and is disposed next to the recording head in the first direction along which the recording target medium is transported;

a plurality of first rib portions provided at predetermined intervals in the second direction, the plurality of first rib portions being located at positions where they can face the optical sensor as the carriage moves, the plurality of first rib portions support the recording target medium;

a plurality of second rib portions provided at predetermined intervals in the second direction, the plurality of second rib portions being located at positions where they can face the recording head as the carriage moves, the plurality of second rib portions support the recording target medium; and a plurality of convexes provided between the plurality of the first rib portions;

wherein the plurality of first rib portions are made of a resin material, wherein the plurality of second rib portions are made of a metal material, wherein each of the plurality of the convexes are made of a resin material, wherein the thicknesses of the first rib portions in the second direction are thinner than the thicknesses of the second rib portions in the second direction, wherein the plurality of first rib portions and the plurality of second rib portions are provided between the pair of transportation rollers and the pair of ejection rollers, wherein the plurality of the convexes are lower than the first rib portions, and are continuously formed in a region between the adjoined first ribs.

13. The recording apparatus according to claim 12, further comprising convexes and concaves which are formed in a surface between the first rib portions.

14. A recording apparatus comprising:

a transportation path provided in a first direction along which a recording target medium is transported;

a carriage on which a recording head is mounted, the carriage reciprocating in a second direction intersecting with the first direction along which the recording target medium is transported;

an optical sensor which is provided on the carriage and is disposed next to the recording head in the first direction along which the recording target medium is transported;

a plurality of first rib portions provided at predetermined intervals in the second direction, the plurality of first rib portions being located at position where they can face the optical sensor as the carriage moves, the plurality of first rib portions support the recording target medium;

a plurality of second rib portions provided at predetermined intervals in the second direction, the plurality of second rib portions being located at position where they can face the recording head as the carriage moves, the plurality of second rib portions support the recording target medium; and a plurality of convexes provided between the plurality of the first rib portions;

wherein the thicknesses of the first rib portions in the second direction are thinner than the thicknesses of the second rib portions in the second direction, wherein a plurality of the first rib portions each include an outside-detection-area rib portion, which is located outside a detection area of the optical sensor, and an inside-detection-area rib portion, which is located inside the detection area of the optical sensor, and a width of the inside-detection-area rib portion is smaller than a width of the outside-detection area rib portion.

* * * * *